United States Patent [19]

Chevalier

[11] Patent Number: 4,783,858

[45] Date of Patent: Nov. 15, 1988

[54] SWEATER HAVING WINDBREAKING CHARACTERISTICS

[76] Inventor: Jack W. Chevalier, 4410 Grove Ave., Richmond, Va. 23221

[21] Appl. No.: 133,279

[22] Filed: Dec. 14, 1987

[51] Int. Cl.[4] ..... A41D 1/04

[52] U.S. Cl. ..... 2/90; 2/97; 2/272

[58] Field of Search ..... 2/90, 69, 93, 97, 115, 2/272, 125

[56] References Cited

U.S. PATENT DOCUMENTS

| | | | |
|---|---|---|---|
| 2,864,093 | 12/1958 | Sumner et al. | 2/97 |
| 2,976,539 | 3/1961 | Brown | 2/93 |
| 4,502,153 | 3/1985 | Lapedes et al. | 2/97 |
| 4,569,874 | 2/1986 | Kuznetz | 2/272 |
| 4,583,247 | 4/1986 | Fingerhut et al. | 2/69 |
| 4,604,759 | 8/1986 | Bowman et al. | 2/97 X |

*Primary Examiner*—Ronald Feldbaum
*Attorney, Agent, or Firm*—Staas & Halsey

[57] ABSTRACT

A sweater having windbreaking characteristics especially usable by active sportsmen such as golfers who must concentrate on their golf swing, is disclosed. The sweater is a relatively thin pullover type which has an outer layer and a layer adjacent the wearer's body of flexible, quiet, warm and soft material with a very thin windproofing layer sandwiched between the outer layer and body layer. Said windproofing layer is divided into five sections or parts: a torso and two lower arm sections which are loosely attached to the inner-facing surface of the outer layer and two upper arm sections loosely attached to the outer facing surface of the body layer in a manner that the windproofing layer does not make any noise, can be very thin because it is protected by the inner and outer layer, and does not restrict the freedom of movement of the wearer.

8 Claims, 1 Drawing Sheet

10
11
12
13
14
15
16
17
18
19
20
21
22
23
24
25
26
27
28
29

SWEATER HAVING WINDBREAKING CHARACTERISTICS

This invention relates to a windbreaking sweater for use in active outdoor activity such as golfing.

Participating in active outdoor activities, such as golf, in cool or cold weather where there may be some wind usually calls for the use of the so-called "windbreaker" jacket. Material used in these jackets tend to be stiff and confining in order to be durable and to block the wind. However, they restrict the free movement of the arms and shoulders and tend to have a crinkling noise when one surface rubs against the other. Since golf and similar activities require upper body mobility and concentration such stiffness and noise are distracting. This is especially true when concentrating on a golf swing at the time when the arms are moving back. Knitted sweaters do not make the noise, but unless they are extremely thick or bulky will not keep out the chilling effect of even the mildest breeze.

The present invention provides a sweater having the soft, flexible, warmth and appearance of a regular knitted pullover sweater, yet has the windbreaking characteristics of the windbreaker jacket without having any of the noise problems and inflexibility of such a jacket. The sweater is a composite of an outer layer equivalent to a normal thin pullover sweater made of a flexible, soft, warm, quiet and knitted material and a body layer made of a similar thin, soft, flexible, quiet material. The body layer may also be a thin sweater. Sandwiched between the body and outer layers is an inner windbreaking layer made up of a very thin windproof material.

The inner layer of windproof material is divided into five major parts or sections. The first part covers the torso extending into the region of the shoulder. A second and third part covers the lower arms and the fourth and fifth part covers the upper arms up to the vicinity of the shoulder. Both the torso and two lower arm parts are preferably attached loosely to the inside or body-facing surface of the outer sweater layer, and the two upper arms parts of the windproof material are attached to the outward facing surface of the body layer.

The five windproofing sections in effect, cover the torso, shoulders and arms to provide the windproofing layer, but yet operate independently and flexibly so that while the torso, shoulder and arms have a windproofing protection, it is not by a solid rigid continuous layer that would restrict movements, especially the critical movement of the arms, elbow joint and shoulder joint which are permitted to move freely without being restricted by a relatively inflexible material being pulled across the back and down the waist. Also, the windproofing inner layer is quiet with none of the noise associated with he normal "windbreaker" jacket.

The windproof layer can be substantially thinner than the material used in the so-called "windbreaker" jacket and does not require any bulk at all since its sole function is to provide a windproof layer which is protected by both the outer sweater layer and the body layer of the soft, flexible, warm, knitted material. It can be as thin as possible so long as it still blocks a reasonable amount of wind.

The combination of the body and outer sweater layers and sandwiched inner windproof layer can provide a thin garment which is still warm and windproof without being bulky, inflexible or noisy, and is ideal for golfers and similar active sportsmen who must have a freedom of movement and at the same time, concentrate on the sporting activity. Most such golfers would not want either a heavy bulky sweater nor a so-called "windbreaker" jacket.

The advantages and function of the invention will be more fully understood from the following detailed description with reference to the accompanying drawings wherein.

Figures 1, 2, 3:
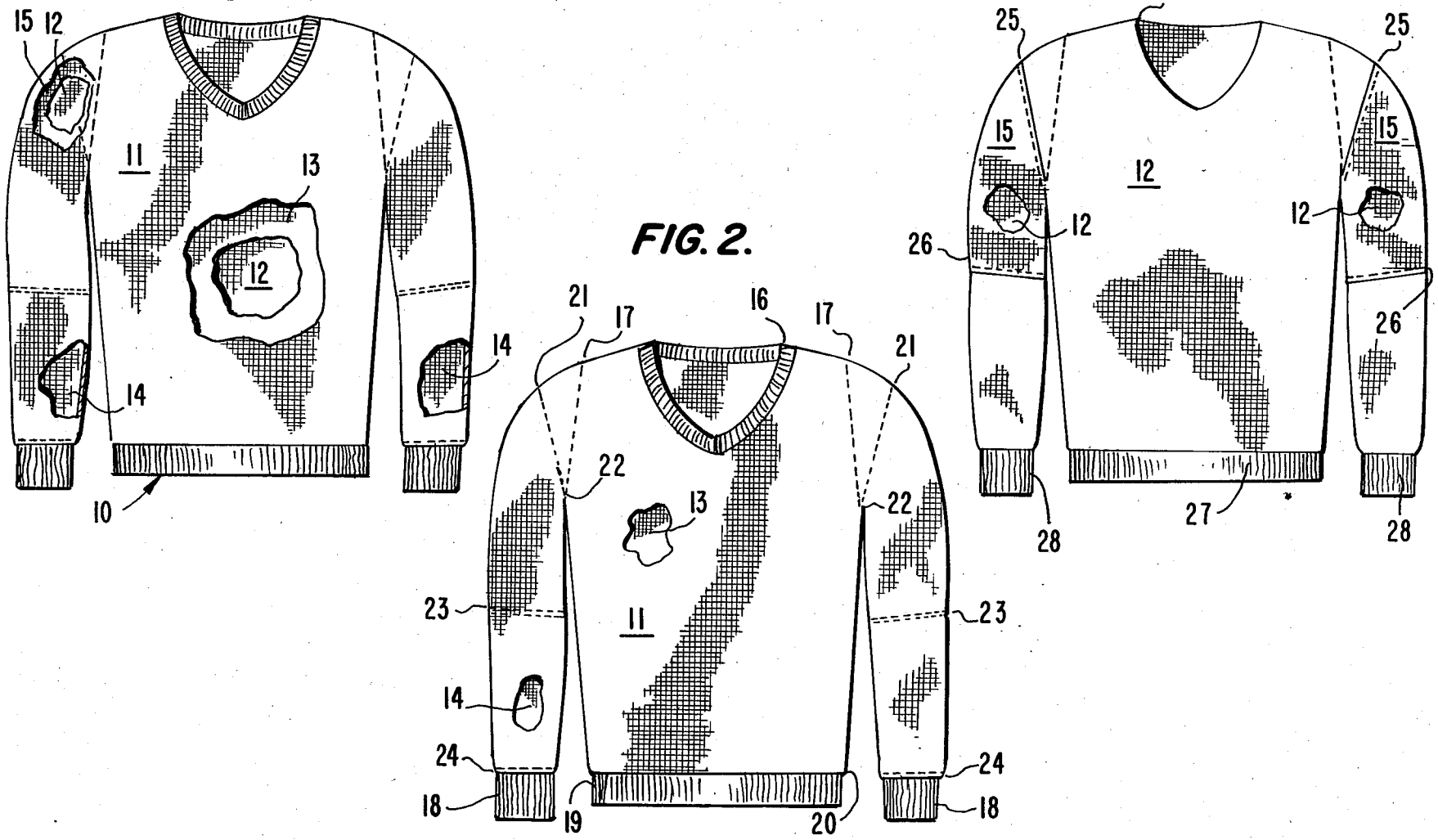
FIG. 1 shows the windbreaking sweater with cutaway sections showing the various layers.
FIG. 2 shows the outer layer of the garment having torso and lower arm windproofing parts attached to the inner surface with the cutaway sections showing the inner windproofing parts.
FIG. 3 shows the body layer having upper arm windproofing parts attached to the outer facing surface with a cutaway of the windproofing parts to show the body layer.

With reference to FIG. 1, there is shown the sweater 10 of this invention having an outer layer 11 and body layer 12. There is also shown an inner windproof layer consisting of five separate parts or sections: the torso part 13, two upper arm parts 15 and two lower arm parts 14. As shown in FIG. 1, the lower arm windproof parts 14 are revealed by a cutaway of only the outer layer 11. The torso and upper arm part of the outer layer have a second underlying layer cutaway. In rhe case of the torso, this reveals the underlying torso windproof part 13 and the body layer 12. In the case of the upper arm part, the cutaway reveals the underlying upper arm windproof part 15 and the body layer 12.

The outer layer is in the form of a knitted thin pullover sweater having the normal appearance, warmth characteristics, flexibility and non-noise or quiet characteristics of such a normal sweater. The body or innermost layer 12 is preferably also a thin sweater similar to the outer layer. However, because the layer 12 adjacent the body is on the inside, its appearance does not have to be the same as the outer layer as long as it is soft, flexible, warm and quiet material, The body layer 12 could be a sweater of different appearance due to color or surface texture so that the garment could be reversed. The inner body layer covers the torso, shoulders and arms.

The windproof-material for the five parts of the inner sandwich layer is very thin with sufficient windproof characteristics to prevent most of the wind from penetrating. There is no need for it to have any bulk since it is protected by both the outer and inner body layer. It is preferably made of a very fine knit fabric which is very thin and coated with a very thin layer such as polyurethane, but it can be made of other materials such as woven nylon which may be coated so long as the material is very thin and has windproofing characteristics to prevent any substantial penetration of the wind. One satisfactory material used is sold under the trademark "LayLa 1000". Such materials are available from many sources including Asakikasei Textiles, Ltd. and Kosugi Sangyo Company, Ltd.

The body layer 11 and outer layer 12 may be non-attached to one another, but preferably they are loosely attached at the neck openings, waist band and cuffs and kept together as a unit with the five-part windproof layer loosely sandwiched therebetween.

With reference to FIG. 2, there is shown the outer layer 11 in the form of a thin pullover sweater with the torso part 13 and lower arm parts 14 of the windproof layer attached to its inner facing surface. As shown in FIG. 2, outer layer 11 has the normal neck edging 16, shoulder seams 17, cuffs 18 and waist band 19.

The torso windproof part 13 extends from the vicinity of the top portion 20 of the waist band 19 throughout the entire torso up to the neck edging 16 and through the shoulder region and down the upper arm to the dotted lines 21. The torso windproof part 13 is made in the form of a shell by being sewn together at the sides and along the top and is fastened to the inner facing surface of the outer layer 11 by being loosely sewn around the inside of the neck edging 16 and loosely sewn from the neck edging along the top of the shoulder to approximately three inches from dotted line 21. Alternatively, it may be loosely sewn all the way to dotted line 21.

The torso part 13 of the windproof layer is also loosely tacked at 22 in the vicinity of the inside surface of the armpit of outer layer 11. The torso windproof part is preferably not attached at the bottom or sides to the inner surface of outer layer 11.

Also shown in FIG. 2 are the lower arm windproof parts 14 which extend from dotted line 24 in the vicinity of the wrist region at the top of the cuffs 18 to the dotted line 26 in the vicinity of the elbow. The lower arm windproof parts 14 are loosely sewn to the inner surface of outer layer 11 at dotted line 23 in and at dotted line 24.

Thus, both the torso windproof part and two lower arm windproof parts are loosely attached to the inner facing surface of the outer layer 11 to loosely move therewith and permit the cuffs and waist band to be folded back onto themselves at the option of the wearer.

With reference to FIG. 3 there is shown the body or innermost layer 12 with the two upper arm windproof parts 15. The upper arm windproof parts are loosely sewn to the surface facing away from the body of the layer 12 along dotted lines 25 at the upper terminuses and dotted lines 26 at the lower terminuses. The upper terminuses of the upper arm windproof parts are selected be generally contiguous to the shoulder terminuses 21 of the torso parts 13 so when the entire windbreaking sweater is assembled, the adjacent terminuses of the torso part 13 and upper arm parts 15 are contiguous to one another in the vicinity of dotted lines 21 of FIGS. 2 and 25 of FIG. 3 and are generally coincident with one another varying from a slight spacing to a slight overlap.

The adjacent and contiguous parts of the windproof layer are designed so they preferably have a small overlap such as up to approximately two inches but may have no overlap or even a small gap at their contiguous edges. What is important is they do not make a substantially crinkling or similar noise doing movement, doing a golf swing and the parts can move with respect to one another to give maximum freedom of movement to a golfer but at the same time provide a substantial resistance to the wind.

The attachment by loose stitching can alternatively be by a series of tacks. The attachment of the parts to the outer and body layers is to hold them in position and to provide a maximum freedom of movement. The upper and lower arm windproof parts are generally in the form of a cylinder with a single longitudinal seam (not shown) and each having an upper edge or terminus and a lower edge or terminus.

The lower terminuses 26 of the upper arm windproof parts terminates at 26 in the vicinity of or contiguous to the upper terminuses 23 of the lower arm windproof parts 14 so as to be, in the assembled windbreaking sweater, coincident with one another varying from only a slight spacing to a small overlap.

The body layer 12 as shown in FIG. 3 has a waist band 27, cuffs 28 and neck opening 29 similar to the outer layer of FIG. 2.

The body layer 12 with its loosely sewn upper arm windproof parts 15 is inserted inside the outer layer 11 and its loosely attached torso windproof part 13 and lower arm windproof parts 14 so as to form a composite windbreaking sweater. The body layer 12 and the outer layer 11 may be loosely attached to one another or remain unattached.

It will be obvious to one skilled in the art that the torso windproof part and lower arm windproof parts may be attached to the outer facing surface of the body layer 12 and the upper arm windproof parts attached to the inner or body facing surface of the outer layer 11 and achieve the same results for the invention. Either way, the composite windbreaking sweater would have a sandwich construction of an outer sweater layer, a five part windproof inner sandwich layer and a body layer.

Applicant has disclosed a comfortable sweater having windbreaking characteristics that is flexible, soft, warm, and quiet when used in active sports such as golf where both concentration and freedom of movement are required.

While a preferred embodiment is shown and described, it is to be understood that there is no intent to limit the invention by the particular form disclosed, but rather it is intended to cover all modifications and alternate constructions falling with the spirit and scope of the invention as defined in the appended claims.

What is claimed is:

1. A windbreaking flexible quiet pullover sweater for physical activity such as golf that requires concentration, including:

an outer layer of warm knitted flexible and soft sweater material;

a body layer of warm, knitted, flexible, soft material inside of and substantially coextensive with said outer layer;

an inner windproof layer of thin windproof material sandwiched between said outer layer and said body layer having five parts;

a torso part of said inner windproof layer having a neck opening and covering the torso and shoulder region;

lower arm parts of said inner windproof layer covering the two lower arm from the elbow region to the wrist region;

both said torso part and said lower arm parts are loosely attached either to the inside surface of said outer layer or the outward facing surface of said body layer;

upper arm parts of said inner windproof layer covering both upper arm regions from the vicinity of the shoulder region to the elbow region which are loosely attached to the outward facing surface of said body layer or the insider surface of said outer-layer ever which said torso part and lower arm parts are not attached to;

said torso part, lower arm parts and upper arm parts of said inner windproof layer together covering substantially the entire torso, shoulder and arm of the wearer with little or no overlap between the said parts which are free to move with respect to each other and together with said body layer and outer layer form a composite sweater.

2. The windbreaking pullover sweater of claim 1, wherein said torso part of said inner windproof layer is loosely attached by sewing only around said neck opening and top of the shoulder and tacked at the armpit.

3. The windbreaking pullover sweater of claim 1, wherein said lower arm parts each have an upper edge in the elbow region and a lower edge in the wrist region.

4. The windbreaking pullover sweater of claim 3, wherein said lower arm parts are loosely attached by being sewn only at said upper edges and said lower edges.

5. The windbreaking pullover sweater of claim 1, wherein said upper arm parts each have an upper edge in the vicinity of the upper arm-shoulder region and a lower edge in an elbow region.

6. The windbreaking pullover sweater of claim 5, wherein said upper arm parts are loosely attached by being sewn only at said upper edges and said lower edges.

7. The windbreaking pullover sweater of claim 6, wherein:

said torso part of said inner windproof layer is loosely attached by sewing only around said neck opening and top of the shoulder and tacked at the armpit;

said lower arm parts each have an upper edge in the elbow region and a lower edge in the wrist region; and said lower arm parts are loosely attached by being sewn only at said upper edges and said lower edges.

8. The windbreaking pullover sweater of claim 7, wherein said outer layer has a neck region, cuff regions and waist region and is loosely attached to said body layer only at said neck region, said cuff regions and said waistband regions.

* * * * *